US006974923B2

(12) United States Patent
Uenishi et al.

(10) Patent No.: US 6,974,923 B2
(45) Date of Patent: Dec. 13, 2005

(54) ELECTRIC CONTACT AND BREAKER USING THE SAME

(75) Inventors: Noboru Uenishi, Itami (JP); Norihito Goma, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 51 days.

(21) Appl. No.: 10/501,960

(22) PCT Filed: Jan. 15, 2003

(86) PCT No.: PCT/JP03/00294

§ 371 (c)(1),
(2), (4) Date: Jul. 21, 2004

(87) PCT Pub. No.: WO03/063191

PCT Pub. Date: Jul. 31, 2003

(65) Prior Publication Data

US 2005/0115812 A1 Jun. 2, 2005

(30) Foreign Application Priority Data

Jan. 21, 2002 (JP) ..... 2002-011121

(51) Int. Cl.[7] ..... H01H 1/02
(52) U.S. Cl. ..... 200/268; 200/266
(58) Field of Search ..... 200/266, 268; 148/431; 420/501, 506; 428/673, 929

(56) References Cited

U.S. PATENT DOCUMENTS 4,072,515 A 2/1978 Motoyoshi et al.
4,131,458 A 12/1978 Satoh et al.
4,672,008 A 6/1987 Shibata
4,680,162 A * 7/1987 Shibata ..... 419/21
4,695,330 A * 9/1987 Shibata ..... 148/281
5,078,810 A * 1/1992 Tanaka et al. ..... 148/678
5,147,278 A * 9/1992 Demura et al. ..... 493/439
5,451,272 A * 9/1995 Uemura et al. ..... 148/431

FOREIGN PATENT DOCUMENTS

| | | | |
|---|---|---|---|
| EP | 508746 A1 * | 10/1992 | ..... C22C 32/00 |
| JP | 58-189913 | 11/1983 | |
| JP | 62-97213 | 5/1987 | |
| JP | 61-114417 | 6/1988 | |
| JP | 10-040764 | 2/1998 | |
| JP | 10-188710 | 7/1998 | |
| JP | 2001-355028 | 12/2001 | |
| WO | WO 00/65623 | 11/2000 | |

* cited by examiner

*Primary Examiner*—Michael Friedhofer
*Assistant Examiner*—Lisa Klaus
(74) *Attorney, Agent, or Firm*—McDermott Will & Emery LLP

(57) ABSTRACT

A high quality electrical contact that is made of a Cd free Ag alloy and can be applied to a breaker is provided.

The electrical contact is made of an Ag alloy containing Sn and In each 1 to 9% by weight, and has a first layer as the surface layer and a second layer as an internal portion. The hardness of the first layer and the hardness of the second layer are equal to or more than 190 and equal to or less than 130, respectively, based on micro Vickers standard defined by JIS. The thickness of the first layer is within the range from 10 to 360 $\mu$m. In particular, the electrical contact has a high quality temperature characteristic as well as a high quality welding resistance characteristic.

7 Claims, 1 Drawing Sheet

ELECTRIC CONTACT AND BREAKER USING THE SAME

TECHNICAL FIELD

The present invention relates to an electrical contact useful for a breaker, such as a molded-case circuit breaker, a no-fuse breaker, a ground fault interrupter, a circuit breaker, a safety breaker, a breaker used for a distribution switchboard, etc. (hereinafter, these various breakers are collectively referred to as a "breaker", or "magnetic switch"); and also relates to a breaker using such electrical contact.

BACKGROUND ART

Ag alloys in which oxides such as Cd, Sn, and In are dispersed have been widely used as electrical contact materials for breakers in a conventional art. In particular, Ag alloys in which the Cd oxides are dispersed are suitable for such a kind of electrical contacts and are widely used for the breakers. However, the drawback of Cd compounds is that they are poisonous. Recently, therefore, there has been strong demand for the development of a Cd-free Sn- or In-dispersed Ag alloy as an electrical contact material which can replace Ag alloys containing Cd oxides. Thus, various materials have been developed for use in electrical apparatuses.

An electrical contact made of Cd-free Ag alloy is suitable for a relatively light load electrical apparatus in which temperature characteristics are important, or a light load apparatus such as a contactor in which contact resistance matters. However, such a Cd-free Ag alloy is inferior in terms of performance as compared with an Ag alloy containing Cd when it is used as a material of an electrical contact for a breaker in which a rated current equal to or more than 10 A is required. For example, at present, most of breakers in which a rated current equal to or more than 10 A and cut-off current equal to or more than 1.5 KA are required, and to which the present invention is mainly directed, use an electrical contact that contains Cd equal to or more than 10% by weight. Cd equal to or more than 10% by weight is contained in electrical contacts used in magnetic switches for a rated current equal to or more than 100 A or those for a forklift using a heavy load contact of a direct current voltage of 86 V and a rush current of 1.9 KA to 2 KA. On the other hand, an electrical contact made of Cd-free Ag alloy is commonly used for a low rated magnetic switch, relay, etc.

The characteristics which are required for an electrical contact for breakers are (1) a welding resistance characteristic, (2) an initial temperature characteristic, (3) a temperature characteristic after an overload test, (4) a temperature characteristic after an endurance test, (5) an insulation characteristic after a cutoff test, and (6) a wear resistance characteristic. When these characteristics are examined with a single material having the same chemical composition and microstructure, it is found that there is a trade-off between some characteristics: between (1) and (2), for example. Therefore, when an electrical contact made of a single material is used, it is necessary to sacrifice one characteristic that is in the trade-off relation with the other. The first characteristic that must be improved so that the electrical contact made of the Cd free Ag alloys replaces the electrical contact containing Cd for the breakers is the welding resistance characteristic. The second characteristic is the temperature characteristic that is in the traded-off relation with the welding resistance characteristic in the same material. It is important that the breakers can be stably used in the areas of relatively high rated current and breaking capacity. Also, it is necessary to improve the wear resistance characteristic and the breaking characteristic to a certain level. Therefore, trials have been made to fabricate a composite contact by combining one material having an excellent characteristic with another material having another excellent characteristic that involves a trade-off between them. Among the trials, a conventional art relatively close to the present invention will now be described.

For example, examples of making such composite materials are described in Japanese Unexamined Patent Application Publication Nos. 58-189913 and 62-97213. In the electrical contacts described in the publications, a material having excellent wear resistance and welding resistance characteristics is used as the surface layers, and a material having an excellent breaking characteristic is used as an inner layer. The contrivance in both of the inventions is such that in electrical contacts, an Ag—Sn—In based alloy is arranged as a surface layer and pure Ag or a high conductive material containing a large amount of Ag is arranged as an inner layer so that arc cutoff is improved.

The former is designed such that in consideration of the arc cutoff during a short circuit, the surface layer is considerably thicker than the inner layer (the inner layer has a thickness of about 300 to 1200 $\mu$m while the surface layer has a thickness of about 100 to 300 $\mu$m.), and in consideration of the case in which the surface layer is consumed, a concavo-convex joint is formed on the boundary between the surface layer and the internal layer so that a part of the surface layer is left so as to be continuously used after the surface layer above the joint has been consumed and damaged by the arc. On the other hand, in the latter, the surface layer is thinner than that of the former (10 to 200 $\mu$m). However, the amount of the oxide dispersed in the surface layer is increased in consideration of the arc cutoff during the short circuit so that the hardness of the surface layer is improved (For example, when the surface layer is made of an Ag alloy in which the oxides of Sn and In are dispersed, the total amount of the oxides are equal to or more than 10% by weight). Since Ag or an alloy containing a large amount of Ag is used for the internal layers in the electrical contacts, it is considered that the arc cutoff time during the short circuit is surely short. However, it is apprehended that, when the electrical contacts are used for a contact for a breaker that cuts off a large current equal to or more than 6 KA, a large arc is generated such that a welding accident may be generated right after the surface layer has been consumed and damaged. Also, a work of forming a concavo-convex portion on the matching surfaces of the upper and lower Ag alloy materials and matching the upper and lower Ag alloy materials is disadvantageous in terms of productivity and economy.

Also, in Japanese Unexamined Patent Application Publication No. 61-114417, a composite electrical contact made of an Ag alloy containing Sn and In, in which the amount of the oxides of Sn and In in the surface layer, in particular, the amount of the Sn oxide is smaller than that in an internal layer, is disclosed Since the surface layer of the contact thus made is less hard than the internal layer, when it is used as a contact for a breaker, the wear resistance characteristic of the surface layer is inferior such that the welding accident may easily occur. Japanese Unexamined Patent Application Publication No. 10-188710 discloses another type of two-layered composite electrical contact. The electrical contact according to the invention is for a breaker suitable for a rated current equal to or less than 100 A. The two layers are an outer circumference layer generally having an excellent welding resistance characteristic and a central layer having an excellent temperature characteristic. Both of the layers are mainly made of an Ag alloy in which the oxides of Cd, Sn, and Ni are dispersed. In the contact, the welding resistance characteristic and the temperature characteristic are adjusted to appropriate levels by controlling the hardness of the two layers and the ratio of the two layers with respect to the contact surface areas thereof. The hardness of the outer circumference layer of the electrical contact is equal to or more than 135 based on micro Vickers standard. The hardness of the central layer is less than 135. An electrical contact according to the invention is suitable for a breaker of a rated current equal to or less than 100 A. However, this contact has the drawback of poisonousness because it contains a large amount of Cd.

It is an object of the present invention to provide an electrical contact which is made of a Cd-free unpoisonous Ag alloy and in which a welding resistance characteristic and a temperature characteristic that involve a traded-off between them are appropriately controlled, and in particular, an electrical contact useful for a breaker having a rated current equal to or more than 10 A and cut-off current equal to or more than 1.5 KA, and to provide a breaker using such contact.

DISCLOSURE OF INVENTION

An electrical contact according to one embodiment of the present invention is made of an Ag alloy containing Sn and In by an amount of 1 to 9 weight % respectively, and has a first layer as a surface layer and a second layer as an internal portion, the hardness of the first layer and the hardness of the second layer being equal to or more than 190 and equal to or less than 130, respectively, in terms of micro Vickers standard defined by JIS, the thickness of the first layer being within the range of 10 to 360 $\mu$m. Also, according to the present invention, there is provided a breaker using the above-mentioned electrical contact.

BEST MODE FOR CARRYING OUT THE INVENTION

Figure 1A:
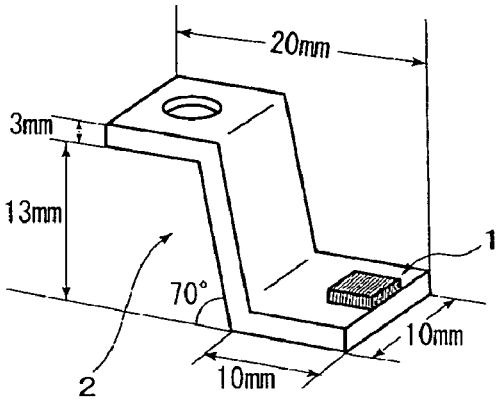
FIG. 1 schematically illustrates a contact assembly used for an electrical test of examples of the present invention.

An electrical contact according to the present invention has a chemical composition in which Sn and In are contained by 1 to 9-weight %, respectively. The remaining portion is composed of Ag and inevitable impurities These components are dispersed usually in the form of compounds, in particular, oxides in an Ag matrix. The amount of Sn is designed to be 1 to 9-weight % because the welding resistance characteristic of the contact deteriorates when the amount of Sn is less than 1% by weight and because the temperature characteristic of the contact is degraded when the amount of Sn is larger than 9% by weight. The amount of Sn is preferably 2 to 7% by weight. Also, the amount of In is designed to be in the range of 1 to 9% by weight because the temperature characteristic of the contact deteriorates when the amount of In is beyond such range and because the welding resistance characteristic deteriorates when the amount of In is larger than 9% by weight, although the welding resistance characteristic is affected by the amount of Sn. The amount of In is preferably 3 to 7% by weight.

The hardness of the first layer is designed to be equal to or more than 190 in terms of micro Vickers standard because the welding resistance characteristic and the temperature characteristic deteriorates when the hardness of the first layer is smaller than this level.

The hardness of the second layer is designed to be equal to or less than 130 in terms of micro Vickers standard because the contact becomes weak and the wear resistance characteristic deteriorates when the hardness of the second layer is larger than this level. Preferably, the hardness of the first layer is equal to or more than 240 and the hardness of the second layer is equal to or less than 120. A hardness value as referred to in the present invention means a hardness value determined according to the micro Vickers standard defined in JIS by measurement at arbitrary points in the respective regions of the first layer and the second layer on a cross-section perpendicular to the surface of an electrical contact. In an electrical contact according to the present invention, it does not matter if there is hardness distribution in each of the first layer and the second layer, provided that the threshold values are cleared at arbitrary points of the respective layers as described above.

In the electrical contact according to the present invention, there exists a difference in hardness (equal to or more than 60 in terms of the micro Vickers standard) on the boundary between the first layer and the second layer, and in such boundary there exists a region (hereinafter, referred to as the "middle portion") having a hardness which is a middle level between the hardnesses of the two layers (that is, the hardness is less than the lower limit of hardness of the first layer and larger than the upper limit of hardness of the second layer). The thickness of this region changes mainly depending on the degree to which thermal diffusion of alloy components proceeds between the layers or to which processing transformation occurs in an Ag-alloying step during manufacturing. Also, an electrical contact according to the present invention may be such that the above-mentioned large difference in the hardness does not exist on the boundary between the two layers, and the hardness may continuously or stepwise decrease in a thickness direction inward from the surface within the scope of constitution defined in claim 1. Such a functionally gradient structure can be obtained by laminating and compressing three or more layers made of Ag alloy materials having different chemical compositions, or by controlling heat treatment conditions in the step of making an Ag alloy.

The thickness of the first layer is made to be 10 to 360 $\mu$m. This is because the welding resistance characteristic or the temperature characteristic deteriorates if the thickness of the first layer is less than the lower limit and because the contact becomes weak, thereby deteriorating the wear resistance characteristic and the temperature characteristic if the thickness of the first layer is larger than the upper limit. The thickness of the first layer is preferably 30 to 120 $\mu$m. An electrical contact according to the present invention may include the middle portion as mentioned above, and in this case, the thickness of the middle portion is preferably equal to or less than 200 $\mu$m. When the thickness of the middle portion is larger than 200 $\mu$m, the wear resistance characteristic and the temperature characteristic of the contact easily deteriorate. The thickness of the middle portion is preferably equal to or less than 100 $\mu$m.

Figure 2:
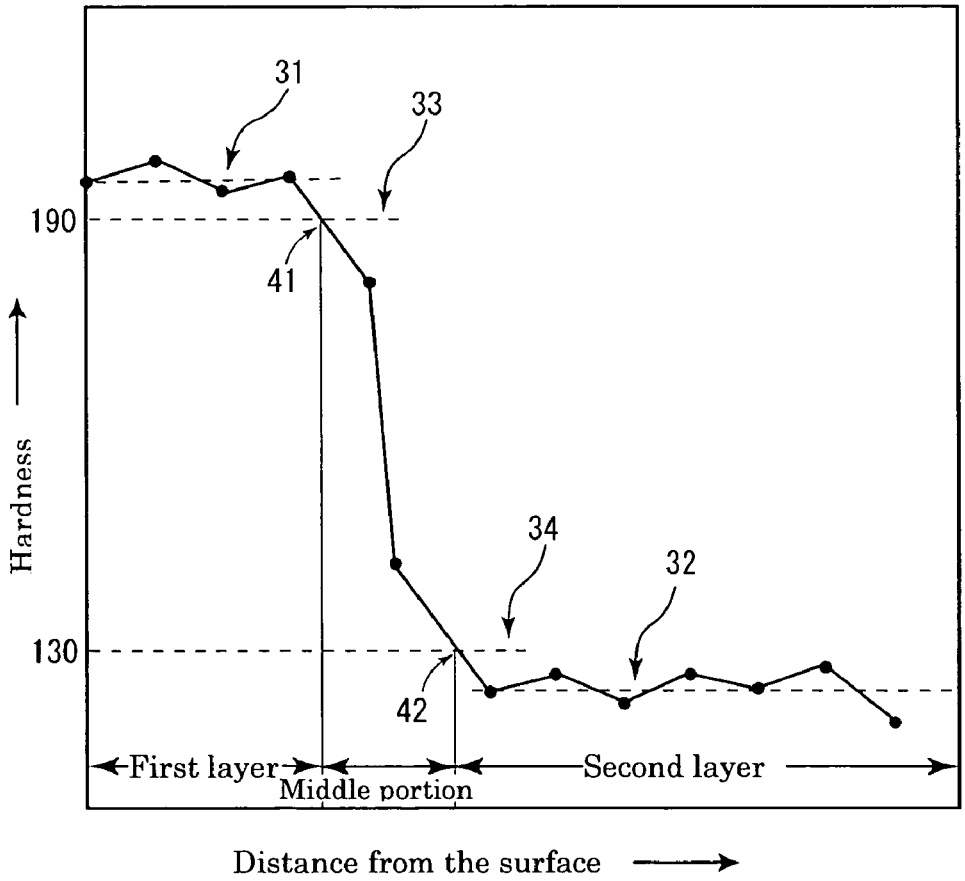
FIG. 2 schematically illustrates a method of measuring the thickness of each layer from the hardness curve of an electrical contact according to the present invention.

The thickness of the first layer and the thickness of the middle portion are checked by the following method using a sample piece of a section that passes through the center of the contact and that is perpendicular to the surface. Five starting points are marked near the surface at the same intervals in a direction horizontal to the surface of the sample piece. Subsequently, hardnesses are measured, substantially at the same intervals sequentially from the surface, from the respective starting points in a direction perpendicular to the surface (i.e., thickness direction) and five hardness curves (actually, line graphs) are plotted. FIG. 2 is a schematic diagram for describing the thickness of the first layer and the middle portion according to the present invention, the definition of the hardness of the first layer and the second layer, and a method of obtaining the thickness and the hardness In order to simplify and clarify the description, only one of the five graphs is described in FIG. 2. In FIG. 2, the vertical axis and the horizontal axis represent the hardness based on the Vickers standard of JIS and the distance from the surface, respectively. The black circular points represent measured data and are connected to each other by a solid line. Among the broken horizontal lines, 31 and 32 denote the arithmetic mean levels of data based on the measured hardnesses of the first layer and the second layer. The horizontal lines denoted by 33 and 34 represent hardness levels 190 and 130, respectively. The points denoted by 41 and 42 are intersections between the hardness curve and the horizontal lines. The measured hardness of the contact according to the present invention is equal to or more than 190 in the first layer and is equal to or less than 130 in the second layer. Since the first layer is thin, when the measurement point is only one, the measured hardness is defined as the hardness of the first layer for the sake of convenience. For calculating the average hardness of the second layer, the data excluding the data of the sparse layer portion (the portion about the middle of the contact, in which a small amount of oxide particles exist as observed by an optical microscope) in the layer is used as the hardness data. The thickness of the first layer according to the present invention is the horizontal distance from the surface to the intersection point 41. The thickness of the middle portion is the horizontal distance between the intersection points 41 and 42. When the number of point data is only one due to the very thin thickness of the middle portion, it is considered that there is no middle layer. The thicknesses of the first layer and the middle portion of the contact specimen are obtained by arithmetically averaging the data obtained from the five hardness curves by the above-mentioned procedure about the thickness of the first layer and the middle portion, respectively The data on the thickness in the examples described later are arithmetic mean values thus obtained. The hardnesses of the first layer and the second layer of the contact specimen are obtained by arithmetically averaging the five data on the minimum measured value of the first layer and the maximum measured value of the second layer as obtained respectively from the five hardness curves according to the above-mentioned procedure.

As mentioned above, when the hardness continuously changes with a functional gradient in the thickness direction, the hardness is obtained according to the following standard for the sake of convenience. That is, the thickness of the first layer is a distance from the surface to the point at which the hardness measured according to the micro Vickers standard is 190. The thickness of the middle portion is the distance from the above-mentioned point to the point at which the hardness is 130.

An electrical contact according to the present invention may contain, as a minor component in addition to the basic components, at least one kind of element selected from the group consisting of Sb, Ca, Bi, Ni, Co, Zn, and Pb. In general, most of these components are dispersed, in the form of compounds, in particular, oxides, in the Ag matrix. The preferable range of dispersion amount varies depending on the respective components: for example, in terms of element converted weight %, 0.05 to 2 (Sb); 0.03 to 0.3 (Ca); 0.01 to 1 (Bi); 0.02 to 1.5 (Ni); 0.02 to 0.5 (Co); 0.02 to 8.5 (Zn); and 0.05 to 5 (Pb). The symbols in the parentheses are relevant elements. In the above-mentioned components, when a dispersion amount is beyond the respective range, the temperature characteristic deteriorates depending on the kind of a breaker. In particular, when the dispersion amount is larger than the upper limit, the welding resistance characteristic concurrently deteriorates depending on the kind of breakers.

In general, the above-mentioned minor components slightly affect the performance of the contact. However, the following are other exemplary components, which may be contained by a very small amount within the scope of the object of the present invention. The preferable amounts vary according to the components: the values in the parentheses are allowable upper limits in terms of weight %, with an element converted unit in the case of a symbol of element and with a molecule converted unit in the case of a molecular formula. Ce, Li, Cr, Li, Sr, Ti, Te, Mn, $AlF_3$, $CrF_3$, and $CaF_2$(5), Ge and Ga(3), Si(0.5), and Fe and Mg(0.1).

As a result of searching for the materials that satisfy the above-mentioned characteristics that are required for the electrical contact, the present inventors found that it is possible to provide electrical contact materials having excellent welding resistance characteristic and temperature characteristic which could not be realized in a conventional art, by using Cd-free materials according to the above-mentioned basic structure.

According to one embodiment of the present invention, the first layer and the second layer have the same chemical composition within the range of the above-mentioned basic structure. The two layers have the same chemical composition but different hardness levels because their microstructures are controlled respectively by the following means.

According to the present invention, the amount of Sn in the first layer may be equal to or larger than the amount of Sn in the second layer within the range of the above-mentioned basic structure. Therefore, it is possible to make the hardness of the first layer almost surely larger than the hardness of the second layer. As a result, it is possible to obtain electrical contact materials suitable for the object of the present invention.

Therefore, the hardness of the first layer almost surely becomes higher than the hardness of the second layer. An electrical contact according to the present invention must be connected to another member such as a supporting metal so as to be mounted in a breaker. The layer may have a shape similar to a metal layer generally formed in order to achieve such a kind of object.

Next, the method of manufacturing the electrical contact according to the present invention will now be described. The composite contact according to the present invention is manufactured by almost the same process as used in making such a kind of Ag alloy according to the conventional art. For example, a melting and casting method is performed in the following procedure. First, ingots are manufactured by melt-casting so as to have the chemical compositions of the first layer and the second layer. After roughly rolling the ingots, two kinds of rolled materials are hot compressed together. At this time or later, a thin connection layer made of pure Ag or a like material as mentioned above is compressed to them if necessary. The resultant product is further rolled into a hoop-shape having a predetermined thickness, and the hoop is punched or further molded so that an Ag alloy material having a size close to the final shape is obtained. The Ag alloy materials thus obtained are subjected to an internal oxidation process so that their metal components such as Sn and In are converted into oxides. Compounds other than the oxides of such component elements may be added before performing melt-casting. If necessary, an appropriate process of heat treatment or adjustment of shape may be performed during or after the rolling process. In this case, it is possible to intentionally control the microstructures of the respective layers by appropriately altering heat treatment conditions so that the material characteristics and levels thereof can be changed.

The electrical contact may be manufactured by a powder metallurgy method. For example, two kinds of powders having predetermined compositions are prepared by mixing Ag powders and compounds of fine oxides of Sn, In, etc., or the compounds of these elements that become new compounds such as oxides by heating, and, if necessary, they are subjected to heat treatment thereafter. The two kinds of powders thus obtained are stacked and filled in a mold and are formed into a preform by compression molding. Various deformation processes such as hot extrusion, hot and cold rolling, and hot forging can be applied to the preform. Also, as in the above-mentioned casting method, if necessary, additional processes such as a heat treatment and adjustment of shape may be performed during or after the rolling process. Thus, it is possible to control the characteristics of the respective layers as desired by appropriately changing the heat treatment conditions.

Also, after forming the material of the second layer in the above-mentioned procedure, the first layer may be formed by various metallurgical means such as thermal spraying, thick film formation by CVD etc., thick film printing by screen printing etc., and baking after coating. In order to join two alloy plates, various means, such as hot extrusion and diffusion bonding by a hot hydrostatic pressure molding method, can be applied. It is possible to intentionally control the microstructure of the respective layers by performing a heat treatment so as to obtain desired characteristics.

Various methods as exemplified later are used as means for controlling the hardness. They are effective when they are applied in the case where the first layer and the second layer have the same chemical composition. For example, there are a method in which only the first layer of the composite contact material obtained by the method described in the preceding paragraphs is rapidly heated and rapidly cooled so as to make the residual stress of the first layer larger than that of the second layer, and a method in which a shot blasting is performed only on the obverse first layer so as to harden it. In the above-mentioned methods, it is possible, for example, to perform a thermo mechanical processing (a heat processing) in which a heat treatment is performed, in addition to a hot rolling or cold rolling, on an Ag alloy plate, and thereafter internal oxidation is performed such that needle-shaped oxide particles that are more minute than those of the second layer are deposited to the first layer, thereby increasing the hardness of the surface. Also, there is a method in which during the above-mentioned rolling or hot compression process, the forging ratio for processing the first layer is differed from that for the second layer, for example.

EXAMPLE 1

Two kinds of ingots were produced by melt-casting Ag alloys having chemical compositions of the first layer and those of the second layer described in the column of the chemical composition of Table I. After roughly processing the ingots, the ingots of the first layer and those of the second layer were hot compressed by hot rolling in an argon atmosphere at the temperature of 850° C. in a state in which an ingot of one layer was put on top of an ingot of the other layer so that composite materials made of two-layered Ag alloys were produced. After preheating each of the obtained composite materials under the same conditions as the hot compression, a thin pure Ag plate was hot compressed to the reverse side surface of the second layer opposite to the first layer so that the thickness of the Ag plate finally became 1/10 of the entire thickness. Thereafter, cold rolling was performed so as to form hoop materials and the hoop materials were punched so as to produce composite contact chips in two shapes, that is, a first shape having the width of 6 mm, the length of 8 mm and the thickness of 2.5 mm, and a second shape having the width of 6 mm, the length of 6 mm and the thickness of 2 mm The obtained chips were kept in an oxygen atmosphere of 4 atm at 750° C. for 170 hours, and thus composite contact specimens were made. The thicknesses of the first layers of the obtained specimens are as shown in Table I. The thickness of the Ag layers was about 1/10 of the thickness of the respective chips.

TABLE I

| Sample | Chemical composition (% by weight) | | | | | | Average hardness | | Thickness of |
|---|---|---|---|---|---|---|---|---|---|
| | First layer | | | Second layer | | | First layer | Second layer | first layer |
| No. | Sn | In | Others | Sn | In | Others | (Hmv) | (Hmv) | (μm) |
| *1 | 0.8 | 0.9 | — | 0.6 | 0.7 | — | 170 | 59 | 50 |
| 2 | 1.2 | 1.2 | — | 1.2 | 1.2 | — | 192 | 65 | 50 |
| 3 | 2.3 | 2.2 | — | 2.2 | 2.1 | — | 195 | 70 | 50 |
| 4 | 2.3 | 9.0 | — | 2.2 | 2.1 | — | 193 | 79 | 50 |
| 5 | 9.0 | 3.1 | — | 2.2 | 2.1 | — | 250 | 125 | 50 |
| 6 | 3.4 | 3.4 | — | 3.2 | 3.1 | — | 240 | 110 | 50 |
| 7 | 5.0 | 5.0 | — | 5.0 | 5.0 | — | 280 | 112 | 50 |
| 8 | 7.0 | 7.0 | — | 7.0 | 7.0 | — | 290 | 125 | 50 |
| 9 | 8.0 | 7.5 | — | 7.8 | 7.2 | — | 302 | 127 | 50 |
| *10 | 9.2 | 9.2 | — | 9.1 | 9.1 | — | 310 | 134 | 50 |
| 11 | 1.2 | 1.2 | Sb | 1.2 | 1.2 | Sb | 200 | 75 | 50 |

TABLE I-continued

| Sample | Chemical composition (% by weight) | | | | | | Average hardness | | Thickness of |
|---|---|---|---|---|---|---|---|---|---|
| | First layer | | | Second layer | | | First layer | Second layer | first layer |
| No. | Sn | In | Others | Sn | In | Others | (Hmv) | (Hmv) | (μm) |
| 12 | 2.3 | 2.2 | " | 2.2 | 2.1 | " | 88 | 69 | 50 |
| 13 | 2.3 | 9.0 | " | 2.2 | 2.1 | " | 200 | 70 | 50 |
| 14 | 9.0 | 3.1 | " | 2.2 | 2.1 | " | 260 | 128 | 50 |
| 15 | 3.4 | 3.4 | Ni | 3.2 | 3.1 | Ni | 250 | 115 | 50 |
| 16 | 5.0 | 5.0 | Ni | 5.0 | 5.0 | Ni | 293 | 115 | 50 |
| 17 | 9.0 | 9.0 | Bi | 9.0 | 8.9 | Bi | 300 | 128 | 50 |
| *18 | 9.2 | 9.2 | " | 9.1 | 9.1 | " | 320 | 139 | 50 |
| *19 | 5.0 | 5.0 | Sb and others | 5.0 | 5.0 | Sb and others | 300 | 116 | 9 |
| 20 | " | " | Sb and others | " | " | Sb and others | 287 | 114 | 11 |
| 21 | " | " | Sb and others | " | " | Sb and others | 286 | 110 | 26 |
| 22 | " | " | Sb and others | " | " | Sb and others | 286 | 110 | 32 |
| 23 | " | " | Sb and others | " | " | Sb and others | 286 | 110 | 70 |
| 24 | " | " | Sb and others | " | " | Sb and others | 286 | 110 | 120 |
| 25 | " | " | Sb and others | " | " | Sb and others | 286 | 110 | 260 |
| 26 | " | " | Sb and others | " | " | Sb and others | 286 | 110 | 350 |
| *27 | " | " | Sb and others | " | " | Sb and others | 286 | 110 | 370 |
| 28 | " | " | Sb and others | 5.0 | 5.0 | Sb and others | 282 | 113 | 50 |
| 29 | " | " | Sb and others | 5.0 | 5.0 | Sb and others | 285 | 102 | 50 |
| 30 | 4.0 | 3.0 | Ni and others | 4.0 | 3.0 | Ni and others | 270 | 100 | 50 |
| *31 | " | " | Ni and others | " | " | Ni and others | 170 | 100 | 50 |
| *32 | " | " | Ni and others | " | " | Ni and others | 270 | 132 | 50 |
| 33 | 7.0 | 7.0 | — | 7.0 | 7.0 | — | 290 | 125 | 50 |
| 34 | 7.0 | 7.0 | — | 7.0 | 7.0 | — | 293 | 128 | 50 |
| *35 | 4.0 | 7.0 | — | 7.0 | 7.0 | — | 136 | 180 | 50 |
| *36 | 3.4 | 3.4 | — | — | 3.1 | — | 150 | 68 | 200 |

Note)
The mark * denotes a comparative example. The amounts of the other components, Sb, Ni, and Bi, in the samples 11 to 18 are each 0.2% by weight. The chemical compositions of the first layers and the second layers in the samples 19 to 27 are the same. With respect to the other components and the amounts thereof, in both layers, the amounts of Sb, Co, and Zn are 0.1 each and the amounts of Ni and Bi are 0.2 each in terms of % by weight. With respect to the other components and the amountsthereof in the sample 28, the amounts of Sb, Pb, Ni, Bi, Co, and Zn are 0.1 each and the amount of Ca is 0.2 in terms of % by weight. With respect to the other components and the amounts thereof in the sample 29, the amounts of Sb, Ni, Ca, Bi, Co, and Zn are 0.1 each and the amount of Pb is 0.5 in terms of % by weight. With respect to the other components and the amounts thereof in the samples 30 to 32, the amounts of Ni and Zn are 0.2 each in terms of % by weight. In the chemical compositionsof the first layers and the second layers, the remaining portions other than the components described in Table I consist of Ag and inevitable impurities.

In Table I, the samples 1 to 10 are a group of samples in which the hardness of each layer was controlled by changing the amounts of Sn and In. The samples 11 to 18 are a group of samples in which the amounts of Sn and In were changed, while additional components other than Sn and In were added. The samples 19 to 27 are a group of samples in which the thickness of the first layers was changed. In the samples 28 to 34, both layers, that is, the first layers and the second layers have the same chemical composition. In the samples 28 to 34, the hardness of the first layers was controlled by the following method. First, in the samples 28 to 33, the rolling process sectional area ratio of the first layers was increased by 50% of the rolling process sectional area ratio of the second layers, and the materials of the first layers were annealed at the temperature of 450° C. for 30 minutes under vacuum during the rolling process thereof. Furthermore, after internal oxidation, the surface of the first layers was subjected to shot blasting by alumina beads of #120 at a projection pressure of 3 kgf/cm$^2$ for three minutes.

The sample 34 was manufactured under the same conditions as the above-mentioned samples except that the annealing temperature and the annealing time were 750° C. and 5 hours during the rolling process. Though not described in Table I, in the samples 33 and 34, the middle portions having the thickness of 190 μm and 230 μm were formed, respectively. The sample 35 was manufactured by the methods disclosed in Japanese Unexamined Patent Application Publication No. 61-114417, and the sample 36 was manufactured by the method disclosed in Japanese Unexamined Patent Application Publication No. 58-189913. That is, the sample 35 was obtained by melt-casting the Ag alloys of the first layer and the second layer having the chemical compositions described in Table I, hot compressing and rolling them, and performing internal oxidation on them under the same conditions as described above. The sample 36 was prepared by melt-casting Ag alloys for the first layer and the second layer having the chemical compositions described in Table I, and forming concavo-convex portions having a width of 1 mm and a depth of 0.5 mm at a pitch of 1 mm in a horizontal direction on the matching surfaces of melt-cast ingots for the first layer and the second layer so as to join the concave portion with the convex portion on the matching surfaces, and hot compressing and rolling the resultant material thus joined, and finally performing internal oxidation thereof under the same conditions as described above. The thickness of the first layer and the hardness of the respective samples manufactured by the above-mentioned methods were checked in the above-mentioned procedure, and the results are as shown in Table I. Though not described in the table, the thickness of the middle portions of the samples excluding the samples 33 and 34 was less than 100 $\mu$m.

Figure 1B:
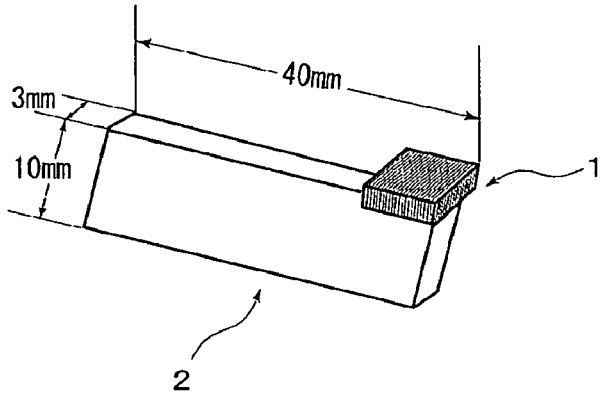

Subsequently, mobile and immobile supporting stands made of electrolytic copper and having such shapes as illustrated in FIG. 1 were prepared. An electrical contact of the first shape was attached to the immobile supporting stand and an electrical contact of the second shape was attached to the mobile supporting stand, using silver brazing respectively. In FIG. 1, the numerals 1 and 2 denote an electrical contact and a supporting metal stand, respectively. FIG. 1(*a*) and FIG. 1(*b*) illustrate an immobile assembly and a mobile assembly, respectively. Then, the assemblies were fixed to two kinds of breakers such as AC 30 A and 50 A rated frames. Five such breaker assemblies were prepared for each composite contact chip pair of each sample. First, the respective initial temperature characteristics of samples were checked by flowing a rated current for 100 minutes using all of the assemblies. Next, a cutoff test was performed under load of 220 V by the cut-off current of 1.5 KA in the case of a 30 A frame and the cut-off current of 5 KA in the case of a 50 A frame, using one assembly for each case, and thereby the welding resistance characteristics were investigated. By flowing the rated current for 100 minutes in continuation thereafter, their temperature characteristics after the cutoff test were checked An overload test was performed, using the assemblies whose initial temperature characteristics were checked, in a manner such that with respect to all of the 30 A frame and 50 A frame, open-and-close operations were repeated 50 times at intervals of five seconds in a state where a current five times the rated current was flown, and the temperature characteristics after the overload test were checked under the same conditions as the conditions under which the initial temperature characteristics were checked An endurance test was conducted, using the assemblies whose initial temperature characteristics were checked, in a manner such that all of the 30 A frame and 50 A frame were subjected to open-and-close operations repeated 6,000 times at intervals of five seconds in a state where the rated current was flown, and subsequently the temperature characteristics after the endurance test were checked under the same conditions as the conditions under which the initial temperature characteristics were checked.

The results of these tests were examined with a five-level evaluation using numbers 1 to 5 in consideration of overall results of the two kinds of frames 30 A and 50 A, and are shown in Table II, identifying the samples with the same sample numbers used in Table I. The level numbers 1 and 2 mean that the samples cannot be used as breakers. The level numbers equal to or more than 3 mean that the samples can be used as breakers. The level numbers equal to or more than 3 can be used as breakers. The level number 5 corresponds to an excellent performance. The above are true also for the following examples.

TABLE II

Results of electrical tests (five-level overall evaluation)

| Sample number | Welding resistance characteristic | Initial temperature characteristic | Temperature characteristic after overload test | Temperature characteristic after endurance test | Temperature characteristic after short circuit test |
|---|---|---|---|---|---|
| *1 | 1 | 5 | 2 | 2 | 1 |
| 2 | 2 | 5 | 3 | 3 | 3 |
| 3 | 3 | 5 | 4 | 3 | 3 |
| 4 | 3 | 5 | 3 | 3 | 3 |
| 5 | 5 | 3 | 3 | 4 | 3 |
| 6 | 4 | 4 | 4 | 4 | 4 |
| 7 | 4 | 3 | 4 | 4 | 3 |
| 8 | 4 | 3 | 4 | 4 | 3 |
| 9 | 4 | 3 | 3 | 3 | 3 |
| *10 | 4 | 2 | 1 | 2 | 1 |
| 11 | 4 | 4 | 3 | 3 | 3 |
| 12 | 4 | 4 | 3 | 4 | 4 |
| 13 | 4 | 4 | 3 | 3 | 3 |
| 14 | 5 | 3 | 3 | 3 | 3 |
| 15 | 4 | 4 | 4 | 4 | 4 |
| 16 | 4 | 3 | 4 | 4 | 3 |
| 17 | 4 | 3 | 3 | 4 | 3 |
| *18 | 3 | 3 | 2 | 3 | 2 |
| *19 | 2 | 3 | 3 | 2 | 3 |
| 20 | 3 | 4 | 3 | 3 | 3 |
| 21 | 4 | 4 | 3 | 3 | 4 |
| 22 | 4 | 4 | 3 | 4 | 4 |

TABLE II-continued

Results of electrical tests (five-level overall evaluation)

| Sample number | Welding resistance characteristic | Initial temperature characteristic | Temperature characteristic after overload test | Temperature characteristic after endurance test | Temperature characteristic after short circuit test |
|---|---|---|---|---|---|
| 23 | 4 | 4 | 4 | 4 | 4 |
| 24 | 4 | 4 | 4 | 4 | 4 |
| 25 | 4 | 4 | 4 | 3 | 4 |
| 26 | 3 | 3 | 4 | 3 | 4 |
| *27 | 2 | 2 | 4 | 3 | 4 |
| 28 | 4 | 3 | 4 | 4 | 3 |
| 29 | 4 | 3 | 4 | 4 | 3 |
| 30 | 4 | 4 | 4 | 4 | 4 |
| *31 | 2 | 5 | 2 | 2 | 2 |
| *32 | 2 | 4 | 2 | 4 | 2 |
| 33 | 4 | 3 | 4 | 4 | 3 |
| 34 | 3 | 3 | 4 | 3 | 3 |
| *35 | 2 | 4 | 2 | 2 | 2 |
| *36 | 1 | 5 | 1 | 2 | 1 |

Note) The mark * denotes a comparative example.

The above-mentioned results indicate the following. (1) The breakers using the contacts according to the present invention in which the amounts of Sn and In are controlled to be within the range from 1 to 9% by weight in both the first layer and the second layer; the hardness based on the micro Vickers standard in the first layer is equal to or more than 190 and the hardness based on the micro Vickers standard in the second layer is equal to or less than 130; and the thickness of the first layer is controlled to be within the range from 10 to 360 μm are within the practically usable ranges in the overall evaluation. On the other hand, the breakers using the contacts that fall outside the scope of the present invention do not reach the practically usable levels in the overall evaluation. (2) The above is true of the case in which a small amount of components such as Sb and Ni are further contained in addition to Sn and In. (3) In the contact chips manufactured by the methods described in Japanese Unexamined Patent Application Publication No. 61-114417 and Japanese Unexamined Patent Application Publication No. 58-189913, the hardness levels were outside the scope of the present invention, and hence the breaker assemblies in which these contact chips were mounted could not achieve the overall performances of practically usable levels, except for some characteristics.

EXAMPLE 2

Composite contacts in which the first layers and the second layers had the same chemical compositions as the samples 3, 8, and 9 of Table I were manufactured. The second layers were manufactured by the same method as illustrated in Example 1 and the first layers were formed on the second layers using a reduced pressure plasma thermal spraying method. First, two shapes of materials made of Ag alloy of the same chemical composition as the chemical composition of the second layers and having the same shape as in Example 1, to one surface of which a thin pure Ag layer was hot compressed, were manufactured using the same method as described in Example 1. Then, the respective materials were placed in a vacuum chamber in a manner such that the pure Ag layer side is disposed as the reverse side, and the first layers were formed on the obverse surfaces of the respective materials by the following methods. First, Ag alloy pre-alloy powders having the same chemical composition as the first layers of the samples 3, 8, and 9 of Table I and having a particle size distribution from sub-micron to 2 μm were prepared as raw materials. Then, using an Argon gas as a carrier gas for feeding, the prepared pre-alloy powders were sprayed on and fixed to the surfaces of the second layers by the reduced pressure plasma thermal spraying method, and thus the first layers were formed. During the thermal spraying, the tip of a thermal spraying gun was automatically swung so that the first layers were formed uniformly by the application of thermal spray. Also, in order to improve the closeness between the first layers and the second layers, the surfaces of the first layers were preliminarily exposed to plasma flame prior to the thermal spraying. Internal oxidation was performed on the obtained composite materials under the same conditions as illustrated in Example 1. In all of the chips, the final thickness of the first layers was 50 μm and the thickness of the pure Ag layers was about 1/10 of the total thickness of the chips.

The hardness of the first layer and the second layer and the thickness of the first layer of each obtained contact chip were checked by the same method as illustrated in Example 1. The results are shown in Table III. Though not described in the table, the thickness of the middle portions of all of the samples was less than 100 μm. The contact chips were mounted to the breakers of the same shape by the same method as in Example 1, and an electrical test was performed in the same procedure as in Example 1. The results are also shown in Table III.

It is understood from these results that the thermal spraying method can also be used in order to manufacture composite electrical contacts in which the chemical compositions of the first layers and the second layers are the same as in the case of using a casting method and which have the hardness within the scope of the present invention, and that breakers having excellent practical performance can be fabricated by using these contacts.

TABLE III

| Sample number | Chemical composition | Average hardness (mHv) First layer | Average hardness (mHv) Second layer | Results of electrical test (five-level overall evaluation): Welding resistance characteristic | Initial temperature characteristic | Temperature characteristic after overload test | Temperature characteristic after endurance test | Temperature characteristic after short circuit test |
|---|---|---|---|---|---|---|---|---|
| 37 | The same as sample 3 | 198 | 70 | 3 | 5 | 4 | 4 | 3 |
| 38 | The same as sample 8 | 295 | 125 | 4 | 3 | 4 | 4 | 3 |
| 39 | The same as sample 9 | 303 | 127 | 4 | 3 | 3 | 3 | 3 |

EXAMPLE 3

Composite contacts in which the first layers and the second layers had the same chemical compositions as the samples 1, 2, 4, 5 and 6 of Table I were manufactured. The second layers were formed by the same method as illustrated in Example 1 and the first layers were formed on the second layers by a deposition method. First, using the same method as illustrated in Example 1, two shapes of materials having the same shape as illustrated in Example 1 and having a thin pure Ag layer hot-compressed to one surface thereof were manufactured, which materials were made of Ag alloy of the same chemical composition as the second layers Then, the respective materials were placed, with the pure Ag layer side disposed as the reverse side, in a vacuum chamber, and the first layers were formed on the obverse surfaces of the respective materials in the following manner. First, targets having the same chemical compositions as the first layers of the samples 1, 2, 4, 5 and 6 of Table I was prepared. In order to prevent Sn from re-evaporating, the temperature of the vacuum chamber was maintained at 180° C. and the pressure of the vacuum chamber was maintained at an Argon gas partial pressure of several Torr to several tens Torr. Under such conditions, the first layers having the same composition as the targets were formed, using the targets and by deposition according to a magnetron spattering method, on the surfaces of the second layers. In order to improve the closeness between the first layer and the second layer, the surfaces of the first layers were preliminarily cleaned with ions generated by a high frequency prior to the deposition. The obtained composite materials were oxidized under the same conditions as in Example 1. Thus, contact chips were fabricated. In all of the chips, the final thickness of the first layers was 50 $\mu$m and the thickness of the pure Ag layers was about 1/10 of the total thickness of the chips.

The hardness of the first layers and the second layers and the thickness of the first layers of the obtained contact chips were checked by the same method as illustrated in Example 1. The results are as described in Table IV. The thickness of the middle portions of all of the samples was less than 100 $\mu$m, though not described in the table. The contact chips were mounted to the breakers of the same shape in the same manner as in Example 1 and an electrical test was performed in the same procedure as in Example 1. The results are also illustrated in Table IV.

TABLE IV

| Sample number | Chemical composition | Average hardness (mHv) First layer | Average hardness (mHv) Second layer | Results of electrical test (five-level overall evaluation): Welding resistance characteristic | Initial temperature characteristic | Temperature characteristic after overload test | Temperature characteristic after endurance test | Temperature characteristic after short circuit test |
|---|---|---|---|---|---|---|---|---|
| *40 | The same as sample 1 | 120 | 56 | 2 | 5 | 2 | 2 | 1 |
| 41 | The same as sample 2 | 196 | 63 | 3 | 4 | 3 | 4 | 3 |
| 42 | The same as sample 4 | 200 | 75 | 3 | 4 | 4 | 3 | 3 |
| 43 | The same as sample 5 | 260 | 122 | 5 | 3 | 3 | 5 | 3 |
| 44 | The same as sample 6 | 258 | 110 | 4 | 4 | 4 | 4 | 4 |

Note) The mark * denotes a comparative example.

These results indicate that with the method of forming the first layers by deposition, composite electrical contacts can be manufactured such that the chemical compositions of the first layer and second layer thereof are the same as in the case of the casting method and their hardness is within the scope of the present invention, and that breakers having excellent practical performance can be provided by using such electrical contacts.

EXAMPLE 4

Materials as crude composite electrical contacts in which the chemical compositions of the first layer and second layer were the same as the samples 2, 3, 7, 19, 20, 22, 24, 26, 27, 30, 31, and 32 of Table I were manufactured in the same procedure as in Example 3. After arranging these materials with the surface of the first layer side positioned upward in a shot-blasting chamber, shot blasting was selectively performed only on the surface by #120 alumina beads. At this time, projection was performed for 3 minutes by projection pressure of 6 kgf/cm$^2$, which is higher than the projection pressure in a common shot blast finishing process. Then, internal oxidation was performed under the same conditions as in Example 1. Thus, contact chip samples were prepared. The combination of sizes of the final chips was the same as in Example 1. The thickness of the first layers was 50 $\mu$m and the thickness of the pure Ag layers was about 1/10 of the total thickness of the chips.

The hardness of the first layers and the second layers and the thickness of the first layers of the obtained contact chips were checked by the same method as illustrated in Example 1. The results are as shown in Table V. The contact chips were mounted to the breakers of the same shape in the same manner as in Example 1, and an electrical test was performed in the same procedure as in Example 1. The results are as shown in Table V.

These results indicate that with the method of forming the first layers by deposition and subsequently subjecting their surfaces to hardening process, it is possible to make composite electrical contacts in which the chemical composition of the first layers and second layers are the same as in the case of casting method and whose hardnesses fall within the scope of the present invention, and that breakers having excellent practical performance can be provided by using such composite electrical contacts.

TABLE V

| Sample number | Chemical composition | Average hardness (mHv) | | Results of electrical test (five-level overall evaluation) | | | | |
|---|---|---|---|---|---|---|---|---|
| | | First layer | Second layer | Welding resistance characteristic | Initial temperature characteristic | Temperature characteristic after overload test | Temperature characteristic after endurance test | Temperature characteristic after short circuit test |
| 45 | The same as sample 2 | 190 | 63 | 3 | 4 | 3 | 3 | 3 |
| 46 | The same as sample 3 | 193 | 69 | 3 | 5 | 4 | 3 | 3 |
| 47 | The same as sample 7 | 275 | 110 | 4 | 3 | 4 | 4 | 3 |
| *48 | The same as sample 19 | 287 | 114 | 2 | 5 | 3 | 2 | 3 |
| 49 | The same as sample 20 | 287 | 114 | 3 | 4 | 3 | 3 | 4 |
| 50 | The same as sample 22 | 286 | 110 | 4 | 4 | 3 | 4 | 4 |
| 51 | The same as sample 24 | 286 | 110 | 4 | 4 | 4 | 4 | 4 |
| 52 | The same as sample 26 | 286 | 110 | 4 | 3 | 4 | 3 | 4 |
| *53 | The same as sample 27 | 286 | 110 | 3 | 2 | 4 | 3 | 4 |
| 54 | The same as sample 30 | 267 | 100 | 4 | 4 | 4 | 4 | 4 |
| *55 | The same as sample 31 | 170 | 100 | 2 | 5 | 2 | 2 | 2 |
| *56 | The same as sample 32 | 270 | 134 | 2 | 4 | 2 | 4 | 2 |

Note) The mark * denotes a comparative example.

EXAMPLE 5

Composite electrical contacts in which the first layers and the second layers have the same chemical compositions as the samples 7, 16, 21, 23, and 28 of Table I were manufactured. As in Example 1, the Ag alloys of the chemical compositions of the first layers and those of the second layers were melt-cast into ingots, respectively. After hot-compressing the materials prepared by rolling the ingots, thin pure Ag layers were hot-compressed to the second layers, and the resultant products were rolled to produce hoop materials. Then, after annealing the materials under vacuum equal to or less than $10^{-5}$ Torr at the temperature of 300° C. for two hours, the materials were punched into two shapes the same as in the case of Example 1. Thus, composite materials were obtained. Then, internal oxidation was performed on the materials in the same manner as in Example 1. Thus, contact chip samples were prepared. The combined size of the final chips was the same as illustrated in Example 1. The thickness of the first layers was all 50 μm and the thickness of the pure Ag layers was about 1/10 of the total thickness of the chips.

The hardness of the first layers and the second layers and the thickness of the first layers of the obtained contact chips were checked by the same method as illustrated in Example 1. The results are illustrated in Table VI. Though not described in the table, the thickness of the middle portions of all of the samples was less than 100 μm. The contact chips were mounted to the breakers of the same shape in the same manner as in Example 1, and an electrical test was performed in the same procedure as in Example 1 The results are as shown in Table V. These results indicate that with a method in which the Ag alloy materials manufactured by a casting method are compounded and the compounded materials are annealed at a relatively low temperature prior to an oxidation process, it is possible to manufacture composite electrical contacts in which the chemical composition of the first layers and the second layers are the same as in the case of the casting method, and whose hardness fall within the scope of the present invention, and that it is possible to provide breakers having excellent practical performance by using such composite electrical contacts.

TABLE VI

| Sample number | Chemical composition | Average hardness (mHv) First layer | Average hardness (mHv) Second layer | Results of electrical test (five-level overall evaluation): Welding resistance characteristic | Initial temperature characteristic | Temperature characteristic after overload test | Temperature characteristic after endurance test | Temperature characteristic after short circuit test |
|---|---|---|---|---|---|---|---|---|
| 57 | The same as sample 7 | 278 | 110 | 4 | 3 | 4 | 4 | 3 |
| 58 | The same as sample 16 | 290 | 115 | 4 | 3 | 4 | 4 | 3 |
| 59 | The same as sample 21 | 286 | 110 | 4 | 4 | 3 | 3 | 4 |
| 60 | The same as sample 23 | 286 | 110 | 4 | 4 | 4 | 4 | 4 |
| 61 | The same as sample 28 | 284 | 110 | 4 | 4 | 4 | 3 | 4 |

EXAMPLE 6

Composite electrical contacts in which the first layers and the second layers had the same chemical compositions as the chemical compositions of the samples 6 and 8 of Table I were manufactured. As in Example 1, the Ag alloys of the chemical compositions of the first layers and those of the second layers were melt-cast and rolled into plate shapes. Subsequently, in order to maintain closeness between the plate-shaped materials, after preliminarily micro-welding the contact portions thereof, the plate-shaped materials were heated at a temperature of 800° C. in the atmosphere and were molded by hot extrusion at the extrusion cross-sectional ratio of 80. The thin pure Ag layers were hot compressed to the second layers of the extruded materials under the same conditions as illustrated in Example 1 After rolling the obtained materials, the resultant materials were punched into two shapes the same as in Example 1. Thus composite materials were obtained. Internal oxidation was performed on the obtained materials in the same procedure as in Example 1. Thus contact chip samples were prepared. The combined size of the above-mentioned final chips was the same as illustrated in Example 1. The thickness of the first layers was all 50 μm and the thickness of the pure Ag layers was about 1/10 of the total thickness of the chips.

The hardness of the first layers and the second layers and the thickness of the first layers of the obtained contact chips were checked by the same method as illustrated in Example 1. The results are illustrated in Table VII. Though not described in the table, the thickness of the middle portions of all of the samples was less than 100 μm. The contact chips were mounted to the breakers of the same shape in the same manner as in Example 1, and an electrical test was performed in the same procedure as in Example 1. The results are also illustrated in Table VII.

These results indicate that by a method in which two layers of the two-layered Ag alloy plates manufactured by casting and compounding are combined together and the resultant Ag alloy plates are hot extruded and rolled, it is possible to manufacture composite electrical contacts in which the chemical compositions of the first layers and the second layers are the same as in the case of casting method and whose hardnesses fall within the scope of the present invention, and that it is possible to provide breakers having excellent practical performance by using such composite electrical contacts.

TABLE VII

| Sample number | Chemical composition | Average hardness (mHv) First layer | Average hardness (mHv) Second layer | Results of electrical test (five-level overall evaluation): Welding resistance characteristic | Initial temperature characteristic | Temperature characteristic after overload test | Temperature characteristic after endurance test | Temperature characteristic after short circuit test |
|---|---|---|---|---|---|---|---|---|
| 62 | The same as sample 6 | 241 | 110 | 4 | 3 | 4 | 4 | 4 |
| 63 | The same as sample 8 | 294 | 125 | 5 | 3 | 4 | 3 | 3 |

EXAMPLE 7

Composite electrical contacts in which the first layers and the second layers had the same chemical compositions as the chemical compositions of the samples 8 and 15 of Table I were manufactured by a powder metallurgical method. First, Ag alloy powders having the chemical compositions corresponding to them were prepared. The Ag alloy powders were subjected to internal oxidation in a rotary kiln under the same conditions of oxygen atmosphere and temperature as in Example 1, and thereafter they were stacked to be filled in molds so as to be molded by compression such that the first layers and the second layers had the same chemical compositions as the samples 8 and 15. Thus, cylindrical preforms having a diameter of 80 mm and overall height of 200 mm were manufacture. In this case, the portions corresponding to the first layers were designed to be 1/10 of the entire preforms. Then, the preforms were heated at a temperature of 800° C. in argon atmosphere and immediately molded into plates by hot extrusion. Subsequently, the thin pure Ag layers were hot compressed to the surfaces of the second layer side of the extruded bodies by the same method as illustrated in Example 1. The materials thus obtained were further rolled into hoops, which were punched into two shapes the same as in Example 1. Thus, electrical contact chip samples were prepared. The combined size of the final chips was the same as illustrated in Example 1. The thickness of the first layers was 50 μm and the thickness of the pure Ag layers was about 1/10 of the total thickness of the chips.

The hardness of the first layers and the second layers and the thickness of the first layers of the obtained contact chips were checked by the same method as illustrated in Example 1. The results are illustrated in Table VIII. Though not described in the table, the thickness of the middle portions of all of the samples was less than 100 μm. The contact chips were mounted in the breakers of the same shape by the same method as illustrated in Example 1 to thus perform an electrical test in the same procedure as illustrated in Example 1. The results are also illustrated in Table VIII.

These results indicate that the powder metallurgical method also can be used to produce composite electrical contacts in which the chemical compositions of the first layers and the second layers are the same as in the case of casting method and whose hardnesses fall within the scope of the present invention, and that breakers having excellent practical performance can be made using such composite electrical contacts.

TABLE VIII

| Sample number | Chemical composition | Average hardness (mHv) First layer | Average hardness (mHv) Second layer | Results of electrical test (five-level overall evaluation): Welding resistance characteristic | Initial temperature characteristic | Temperature characteristic after overload test | Temperature characteristic after endurance test | Temperature characteristic after short circuit test |
|---|---|---|---|---|---|---|---|---|
| 64 | The same as sample 8 | 290 | 125 | 4 | 3 | 4 | 4 | 3 |
| 65 | The same as sample 15 | 247 | 113 | 3 | 4 | 4 | 4 | 4 |

INDUSTRIAL APPLICABILITY

As described above, an electrical contact according to the present invention is made of two-layered Ag alloy containing Sn and In, a first layer having high hardness is designed to be the surface layer and a second layer having hardness lower than the hardness of the first layer is designed to be the inner layer, and the thickness of the first layer is controlled to be within the range from 10 to 360 μm. Therefore, the electrical contact according to the present invention has electrical contact characteristics including such excellent welding resistance characteristic and temperature characteristic as conventionally obtainable only by using an Ag alloy containing Cd. Thus, the electrical contact according to the present invention can be used as a contact for a breaker, replacing an electrical contact composed of Cd-containing Ag alloy. Also, according to the present invention, it is possible to provide a breaker using the above-mentioned electrical contact.

What is claimed is:

1. An electrical contact made of an Ag alloy containing Sn and In by an amount of weight 1 to 9% respectively and comprising a first layer as a surface layer and a second layer as an internal portion, wherein the hardness of the first layer and the hardness of the second layer are equal to or more than 190 and equal to or less than 130, respectively, in terms of micro Vickers standard defined by JIS, and wherein the thickness of the first layer is within the range from 10 to 360 $\mu$m.

2. An electrical contact according to claim 1, wherein the Ag alloy comprises, in addition to Sn and In, at least one kind of element selected from the group consisting of Sb, Ca, Bi, Ni, Co, Zn, and Pb.

3. An electrical contact according to claim 1 or 2, wherein the first layer and the second layer have the same chemical composition.

4. An electrical contact according to claim 1, wherein the amount of Sn in the first layer is equal to or larger than the amount of Sn in the second layer.

5. An electrical contact according to claim 1, wherein the thickness of the first layer is within a range of 30 to 120 $\mu$m.

6. An electrical contact according to claim 1, wherein the hardness of the first layer is equal to or more than 240 in terms of said standard.

7. A breaker using the electrical contact according to any one claim 1.

* * * * *